United States Patent [19]

Harden

[11] 4,071,718

[45] Jan. 31, 1978

[54] FLAT KEYBOARD ASSEMBLY HAVING COVER TYPE MEMBRANE WITH PROTRUSIONS TO ALIGN SWITCH COMPONENTS

[75] Inventor: Phillip L. Harden, Roanoke, Ind.

[73] Assignee: Bowmar Instrument Corporation, Fort Wayne, Ind.

[21] Appl. No.: 734,824

[22] Filed: Oct. 22, 1976

[51] Int. Cl.[2] ..... H01H 13/04; H01H 9/02

[52] U.S. Cl. ..... 200/5 A; 200/159 B; 200/293; 200/308; 200/329

[58] Field of Search ..... 200/1 R, 5 R, 5 A, 17, 200/159 A, 159 B, 275, 302, 329, 330, 340, 46

[56] References Cited

U.S. PATENT DOCUMENTS

| | | | |
|---|---|---|---|
| 3,042,764 | 7/1962 | Hermle | 200/340 X |
| 3,551,616 | 12/1970 | Juliusburger et al. | 200/46 |
| 3,617,660 | 11/1971 | Krakinowski | 200/1 R |
| 3,657,492 | 4/1972 | Arndt et al. | 200/302 X |
| 3,789,167 | 1/1974 | Seeger, Jr. et al. | 200/159 B X |
| 3,806,673 | 4/1974 | Boulanger | 200/17 R X |
| 3,952,174 | 4/1976 | Boulanger et al. | 200/302 |
| 3,995,128 | 11/1976 | Hawkins | 200/302 X |

OTHER PUBLICATIONS

Harris, R. H. et al., "Force Concentrator for Touch Sensitive Panel Using Snap Action Switches", I.B.M. Tech. Disc. Bull., vol. 19, No. 1, June 1976, p. 238.

*Primary Examiner*—James R. Scott
*Attorney, Agent, or Firm*—Gust, Irish, Jeffers & Rickert

[57] ABSTRACT

A flat keyboard assembly including a printed circuit board having conductors on one side thereof. Resilient dome switch elements are supported on the one side of the board in spaced-apart relationship in peripheral contact with certain conductors and adapted to make center contact with other conductors upon the application of force thereon. A sheet of relatively thin insulating material covers the one side of the board, the dome elements and the conductors thereon. A switch-actuating member formed of relatively thin, flexible insulating material is in facing relationship with the insulator sheet and has switch-actuating protrusions thereon respectively in alignment with the switch elements and extending toward and contacting the insulator sheet. The actuating member also has isolator protrusions thereon intermediate the switch-actuating protrusions and respectively in alignment with the spaces between the dome elements and extending toward the insulator sheet. A flat keyboard member also formed of relatively thin, flexible material has one side in facing relationship with the actuator member and has keyboard indicia on its other side respectively in alignment with the switch-actuating protrusions and the switch elements. The board, insulator sheet, actuating member and keyboard member are held in assembled relation with the insulator sheet and actuator member sandwiched between the board and the keyboard member so that deflection of the keyboard member in the region of a particular indicia in response to force manually exerted thereon causes the respective switch-actuating protrusion to actuate the respective switch element through the insulator sheet, force exerted on the keyboard member at a particular indicia being isolated by the isolator protrusions from the dome elements aligned with other indicia.

11 Claims, 6 Drawing Figures

FLAT KEYBOARD ASSEMBLY HAVING COVER TYPE MEMBRANE WITH PROTRUSIONS TO ALIGN SWITCH COMPONENTS

BACKGROUND OF THE INVENTION

1. Field of the Invention

This invention relates generally to keyboard assemblies, and more particularly to a flat keyboard assembly which does not incorporate individual switch-actuating push-buttons.

2. Description of the Prior Art

Keyboard switch assemblies of the type utilized with electronic calculators and for digital control of appliances such as micro-wave ovens and television receivers, conventionally comprise a printed circuit board having a plurality of resilient dome switch elements thereon respectively actuated by individual push-buttons. U.S. Pat. No. 3,796,843, assigned to the assignee of the present application, discloses a keyboard switch assembly in which all of the conductors forming an X-Y switch matrix are disposed on one side of the printed circuit board, the switch elements being triangular shaped so that certain conductors may extend under the switch elements. It has been proposed to provide a flat keyboard assembly in which the push-buttons are replaced by a relatively thin, flexible member having one side in facing relationship with the switch elements so that deflection of the member in a particular area in response to force manually exerted on the other side of the member actuates a respective switch element, the other side of the member having keyboard indicia thereon; however, in such prior flat keyboard assemblies known to the present applicant, force exerted at a particular indicia on the flat keyboard member has not been sufficiently isolated from switch elements aligned with other indicia so that actuation of switch elements in addition to the intended switch element may result. It is therefore desirable to provide a flat keyboard assembly wherein erroneous actuation of switch elements is inhibited.

SUMMARY OF THE INVENTION

The invention, in its broader aspects, includes a support member having opposite sides with a plurality of spaced-apart switches mounted thereon, the switches respectively including elements actuatable from first to second positions in response to force exerted thereon. A switch-actuator member formed of relatively thin, flexible material is positioned in facing relationship with one side of the support member covering the switch elements, the actuator member having switch-actuating protrusions thereon respectively in alignment with the switch elements. A flat keyboard member is provided formed of relatively thin, flexible material having opposite sides with one side in facing relationship with the actuator member on the side thereof remote from the support member. The other side of the keyboard member has keyboard indicia thereon respectively in alignment with the protrusions and switch elements. Means are provided for holding the members in assembled relation with the actuator member sandwiched between the support member and the keyboard member so that deflection of the keyboard member in the region of a particular indicia in response to force manually exerted thereon causes the respective protrusion to apply actuating force on the respective switch element.

In the preferred embodiment of the invention, the actuator member also has isolator protrusions thereon respectively in alignment with the spaces between the switch elements and extending toward the one side of the support member so that force exerted on the keyboard member at a particular indicia is isolated from the switch elements aligned with other indicia.

It is accordingly an object of the invention to provide an improved, flat keyboard assembly.

Another object of the invention is to provide a improved, flat keyboard assembly wherein erroneous actuation of switch elements is inhibited.

A further object of the invention is to provide an improved, flat keyboard assembly wherein force exerted on the flat keyboard member to actuate a particular switch element is isolated from other switch elements.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
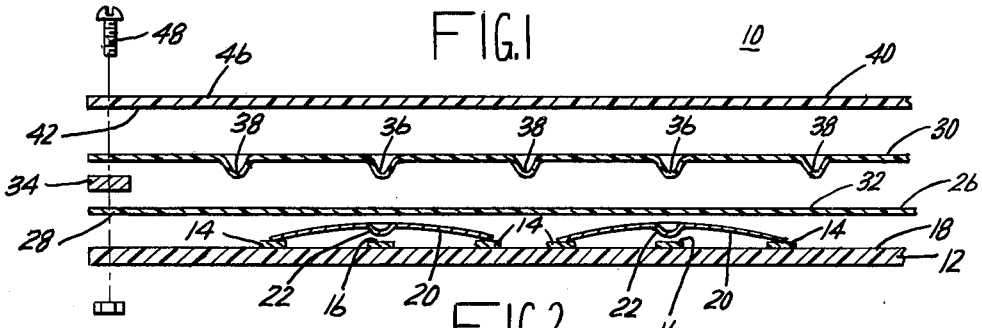
FIG. 1 is an exploded, side cross-sectional view showing one embodiment of the invention.
Figure 2:
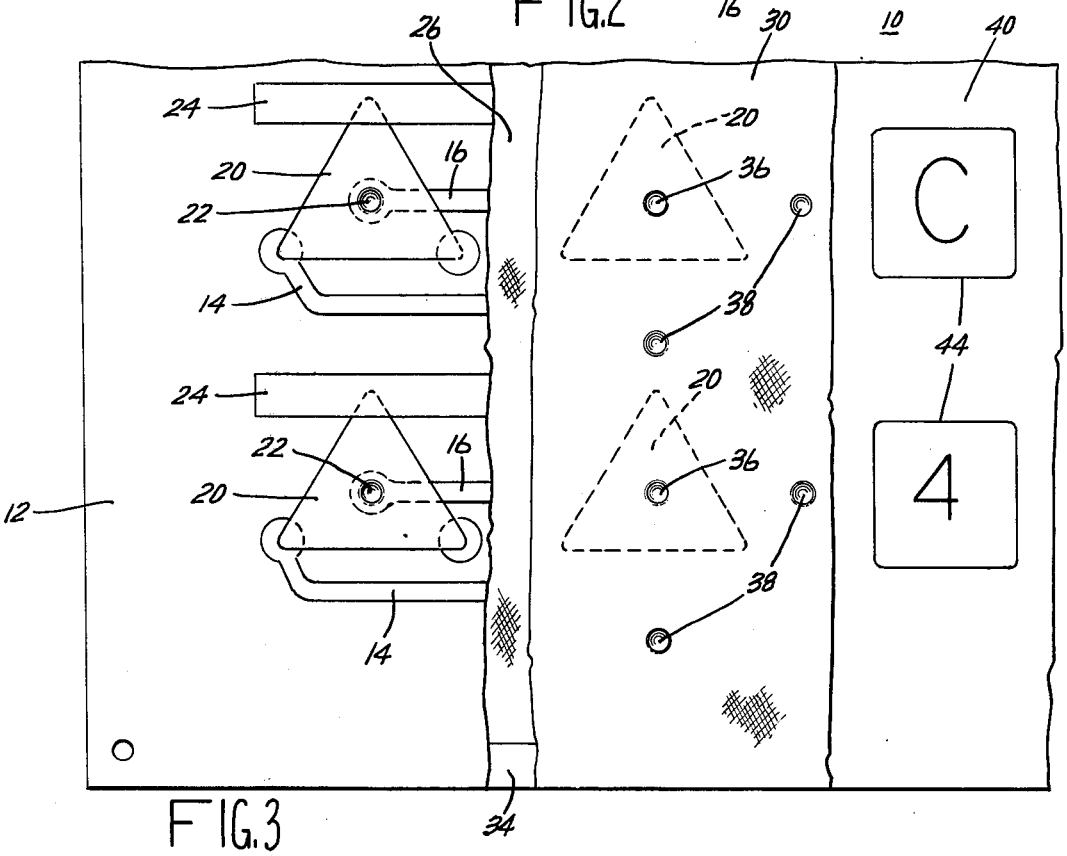
FIG. 2 is a top view, partly broken away, showing the keyboard of FIG. 1.

Referring now to FIGS. 1 and 2 of the drawings, a flat keyboard assembly is shown, generally indicated at 10, which comprises printed circuit board 12 formed of insulating material and having conductors 14, 16 on side 18 thereof. Resilient, metallic dome switch elements 20 are supported on side 18 of board 12 having peripheral engagement with certain conductors 14 and center areas 22 adapted to contact other conductors 16 upon the application of force thereon. Board 12 and switch elements 20 may be of the type shown in said U.S. Pat. No. 3,796,843, or may be of any other conventional type.

Strips 24 formed of suitable relatively thin insulating material, such as Mylar, are supported on side 18 of board 12 and cover portions of each switch element 20. Sheet 26 formed of relatively thin insulating material and having pressure-sensitive adhesive on its side 28 is adhered to side 18 of board 12 and covers conductors 14, 16, switch elements 20 and strips 24. Strips 24 comprise the adhesive on side 28 of sheet 26 to provide an air passage between switch elements 20 in the same row for pressure relief.

Actuator member 30 formed of relatively thin insulating material is disposed in facing relationship with side 32 of insulator sheet 26 and is slightly spaced therefrom by spacers 34. Actuator member 30 has switch actuating protrusions 36 formed therein respectively in alignment with center areas 22 of switch elements 20 and, in this embodiment, extending toward insulators 26. Actuator member 30 also has isolator protrusions 38 formed therein intermediate switch-actuating protrusions 36 and respectively aligned with the spaces between switch elements 20. Actuator member 30 may be formed of suitable insulating material or metal and protrusions 36, 38 may be formed, molded or stamped therein. In the preferred embodiment, isolator member 30 is formed of acrylonitrile butadiene styrene sold by Marbon Chemical Corp. under the trademark "CYCOLAC", such material meeting the Underwriters Laboratory requirements for flame-retardant properties. In the preferred embodiment, protrusions 36, 38 are vacuum-formed in actuator member 30.

Keyboard member 40 has its side 42 in facing relationship with actuator member 30 and has keyboard indicia 44 on its side 46. Keyboard 10 may be held in assembled relation by suitable threaded fasteners 48 and when assembled, actuator member 30 is sandwiched between insulator 26 and keyboard member 40. Keyboard member 40 may be formed of any suitable relatively thin flexible material such as aluminum, stainless steel, leather, vinyl, cardboard or plastic material such as that sold under the trademark "Formica".

It will now be seen that force manually exerted on a particular keyboard indicia 44 will be transmitted through the respective protrusion 36 of actuator member 30 and insulator sheet 26 to the respective switch element 20 to actuate the same from its open position, as shown in FIG. 1, to its closed position with center area 22 contacting the respective conductor 16. It will also be seen that by virtue of the isolator protrusion 36 on actuator member 30 intermediate switch-actuating protrusion 36, force manually exerted on a particular keyboard indicia 44 will not be transmitted to another switch element 20 thereby inhibiting erroneous actuation.

In the embodiment shown in FIGS. 1 and 2, both switch actuating protrusions 36 and isolator protrusions 38 are formed as generally round dimples; however, it will be understood that protrusions 36 and/or protrusions 38 may have any desired or convenient configurations such as star-shaped, X-shaped, square or diamond shaped.

Figure 3:
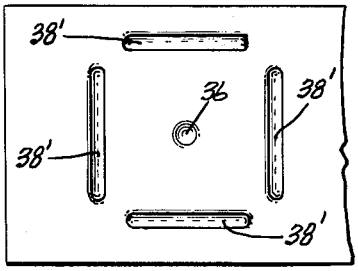
FIG. 3 is a fragmentary view showing another form of actuator member usable in the invention.

Referring now briefly to FIG. 3 in which like elements are indicated by like reference numerals and similar elements by primed reference numerals, here isolator protrusions 38' are in the form of elongated ribs.

Figure 4:
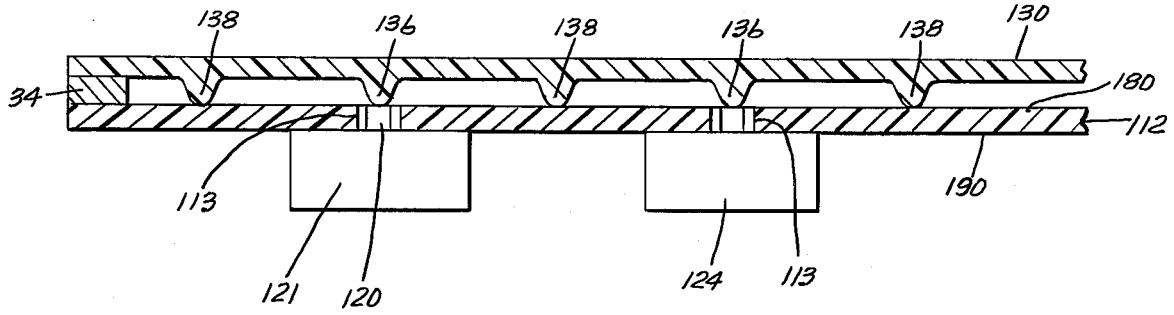
FIG. 4 is a fragmentary, side cross-sectional view showing a modified form of the invention.

Referring now to FIG. 4, here support member 112 which may be formed of insulating material or metal has switches 121 mounted on side 140, switches 121 having push-type actuating elements 120 extending through openings 113 in support member 112 and exposed to side 180 thereof. In this embodiment, actuating member 130, which may be formed of suitable plastic material or metal, has switch-actuating protrusions 136 and isolating protrusions 138 integrally molded thereon, protrusions 136 extending toward and normally engaging switch actuating elements 120. Keyboard member 40 (FIGS. 1 and 2) engages actuating member 130.

Figure 5:
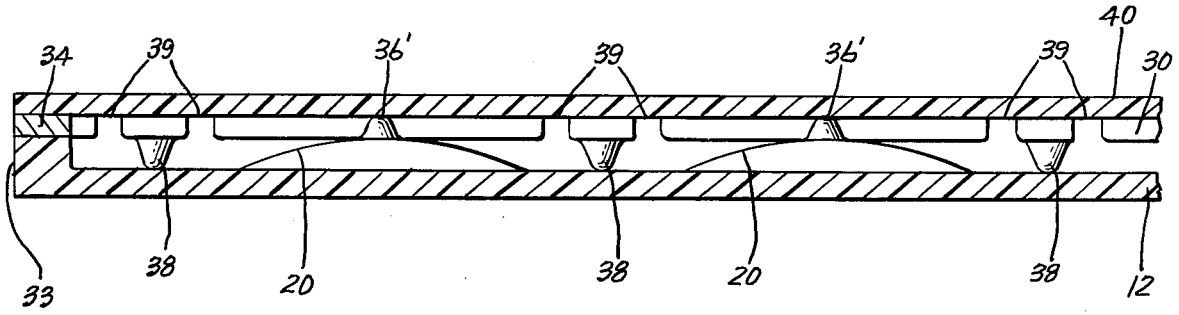
FIG. 5 is a fragmentary, side cross-sectional view showing another modified form of the invention.

Referring now to FIG. 5 in which like elements are indicated by like reference numerals and similar elements by primed reference numerals, switch-actuating protrusions 36' on actuating member 30 extend toward keyboard member 40 rather than toward switch elements 20 as in the case of FIGS. 1 and 2. Here, actuating member 30 has guard protrusions 39 respectively adjacent isolator protrusions 38 and extending toward and engaging keyboard member 40. In this embodiment, insulator sheet 26 of FIGS. 1 and 2 may be eliminated and the periphery of actuator member 30 adhered to rim portion 33 of printed circuit board 12.

Figure 6:
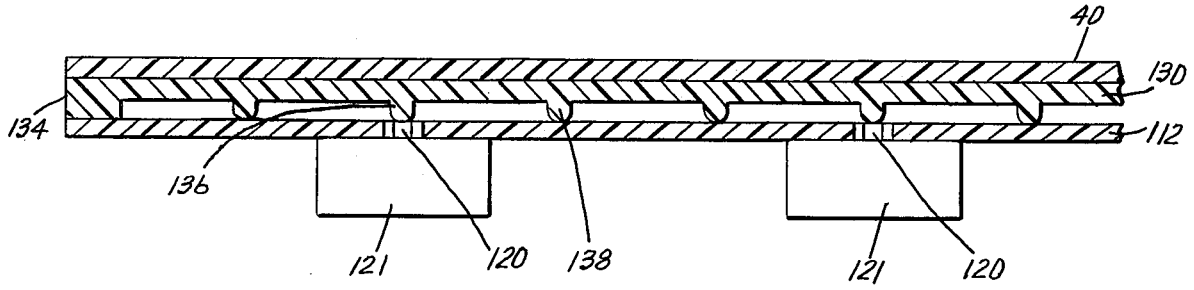
FIG. 6 is a fragmentary, side cross-sectional view showing a further modified form of the invention.

Referring briefly to FIG. 6 showing an embodiment of the invention similar to FIG. 4, spacer 134 may be integrally molded on actuator member 130, as shown, or, alternatively, may be integrally molded on support member 112.

While there have been described above the principles of this invention in connection with specific apparatus, it is to be clearly understood that this description is made only by way of example and not as a limitation to the scope of the invention.

What is claimed is:

1. A flat, thin keyboard assembly comprising: a relatively thin support member having opposite sides, a plurality of spaced-apart switches supported on one side of said support member, said switches respectively including resilient metallic snap-acting dome elements actuatable from first to second positions in response to force exerted thereon, a switch-actuator member formed of relatively thin flexible material and having opposite sides with one side in facing relationship with said one side of said support member and covering said switch elements, said switchactuator member having thin-walled switch-actuating protrusions formed from a side thereof respectively in alignment with said switch elements and respectively defining corresponding indentations on the opposite side thereof, a flat keyboard member formed of relatively thin flexible material having opposite sides with one side in facing relationship with the side of said actuator member remote from said one side of support member, the other side of said keyboard member having keyboard indicia thereon respectively in alignment with said switch-actuating protrusions and switch elements, and means for holding said members in assembled relation with said switch-actuator member sandwiched between said support member and said keyboard member whereby deflection of said keyboard member in the region of a particular indicia in response to force manually exerted thereon causes the respective protrusions to apply actuating force on the respective switch element.

2. The assembly of claim 1 wherein said switch-actuator member also has thin-walled isolator protrusions formed from a side thereof and respectively defining corresponding indentations in the opposite side thereof, said isolator protrusions being respectively in alignment with the spaces between said switch elements and extending toward said one side of said support member whereby force exerted on said keyboard member at a particular indicia is isolated from the switch elements aligned with other indicia.

3. The assembly of claim 2 wherein there are a plurality of said isolator protrusions at least partially surrounding each said switch-actuating protrusion.

4. The assembly of claim 2 wherein said isolator protrusions are elongated ribs.

5. The assembly of claim 1 wherein said switch-actuator and support members are formed of insulating material, and further comprising a sheet of relatively thin insulating material sandwiched between said switch-actuator member and support member and adhered to said one side thereof and covering said dome elements, said switch-actuating protrusions extending toward said sheet, said switch-actuator member also having thin-walled isolator protrusions formed from a side thereof and respectively defining corresponding indentations in the opposite side thereof, said isolator protrusions being intermediate said switch-actuating protrusions and respectively in alignment with the spaces between said dome elements and extending toward said sheet whereby force exerted on said keyboard member at a particular indicia is isolated from the dome elements aligned with other indicia.

6. The assembly of claim 1 wherein said switch-actuator member also has thin-walled isolator protrusions formed from a side thereof and respectively defining corresponding indentations in the opposite side thereof, said isolator protrusions being respectively in alignment with the spaces between said switch elements and extending toward said one side of said support member, said switch-actuator member further having thin-walled guard protrusions formed from a side thereof and respectively defining corresponding indentations in the opposite side thereof, said guard protrusions being respectively adjacent said isolator protrusions and extending toward said keyboard member, said isolator and guard protrusions isolating force exerted on said keyboard member at a particular indicia from the switch elements aligned with adjacent indicia.

7. The assembly of claim 6 wherein said switch-actuating protrusions extend toward said keyboard member.

8. The assembly of claim 1 wherein said keyboard member is a sheet of insulating material.

9. The assembly of claim 1 wherein said keyboard member is a sheet of metal.

10. The assembly of claim 1 wherein said actuator member is formed of insulating material.

11. The assembly of claim 1 wherein said actuator member is formed of metal.

* * * * *